United States Patent [19]

Ohashi et al.

[11] Patent Number: 4,622,713

[45] Date of Patent: Nov. 18, 1986

[54] FLY REMOVING SYSTEM IN TEXTILE MACHINE

[75] Inventors: Kenji Ohashi, Uji; Masao Uehara, Kyoto, both of Japan

[73] Assignee: Murata Kikai Kabushi Kaisha, Kyoto, Japan

[21] Appl. No.: 530,193

[22] Filed: Sep. 9, 1983

[30] Foreign Application Priority Data

Sep. 13, 1982 [JP] Japan ..... 57-159124

[51] Int. Cl.[4] ..... A47L 5/38; A47L 9/10; A47L 9/20

[52] U.S. Cl. ..... 15/312 R; 15/301; 15/352

[58] Field of Search ..... 57/304, 306; 15/301, 15/312 R, 312 A, 353

[56] References Cited

U.S. PATENT DOCUMENTS

| | | | |
|---|---|---|---|
| 3,071,918 | 1/1963 | Hofstetter | 57/304 |
| 3,142,856 | 8/1964 | Maguire | 15/301 |
| 3,373,552 | 3/1968 | Scherr | 57/304 |
| 3,908,346 | 9/1975 | Lee | 57/304 |
| 4,006,033 | 2/1977 | Schewe | 57/304 |
| 4,179,768 | 12/1979 | Sawyer | 15/353 |

*Primary Examiner*—Harvey C. Hornsby
*Assistant Examiner*—Scott J. Haugland
*Attorney, Agent, or Firm*—Spensley Horn Jubas & Lubitz

[57] ABSTRACT

A fly removing system in a textile machine wherein an air curtain is formed by an air ejected from a compressed air supply source and flies are conducted to a lower portion of the textile machine. At the lower portion of the textile machine, a fly collector device is mounted and a cleaning device with a suction pipe is adapted to move along the textile machine and to suck in as fly lumps from the fly collector device.

6 Claims, 9 Drawing Figures

FLY REMOVING SYSTEM IN TEXTILE MACHINE

BACKGROUND OF THE INVENTION

The present invention relates to a fly removing system in a textile machine.

In textile machines such as spinning frames, winders and twisting machines, particularly in those which employ a spun yarn as a yarn to be processed, the formation of flies due to contact and friction with other articles during unwinding of yarn is unavoidable. Therefore, in factories equipped with a large number of such textile machines, how to remove a large quantity of flies is important for attaining a better working environment. If flies floating in the air adhere to the yarn being processed, this will lead to deterioration of the quality of the package which has wound up such yarn.

In view of such inconvenience, various measures for removing flies have been proposed, but are still unsatisfactory.

SUMMARY OF THE INVENTION

The present invention relates to a pneumatic cleaning system in a textile machine and particularly relates to a fly removing system.

An object of the present invention is to provide an improved system capable of overcoming the above-mentioned problem and minimizing the adhesion of flies to yarn being processed thereby.

The present invention provides a system including a fly collecting device mounted at the lower portion of a textile machine and a cleaning device provided with a suction pipe, the cleaning device being adapted to move along the textile machine, suck in as fly lumps, and the flies which have been collected by the fly collecting device, being gathered the fly lumps in a single place through the suction pipe and then discarded them.

According to the present invention, a fly collecting device which comprises a fly collector box and a scrape-up member for scraping up the flies deposited on the collector box and storing the scraped-up flies as fly lumps in a storage box is provided at the lower portion of a textile machine, while a cleaning device is provided for movement along the textile machine, the cleaning device having a suction pipe for sucking the fly lumps while the cleaning device moves along the textile machine, storing the sucked fly lumps and discharging the stored fly lumps into a fixed dust box in a predetermined position of the travelling path. Consequently, the flies floating in the lower portion of the textile machine where flies are apt to be deposited can be scraped up positively by the fly collecting device and then removed by suction as fly lumps, and in this way a large quantity of flies can be removed efficiently. Further, the fly lumps can be gathered in a single place and the fly discarding operation is easy.

DETAILED DESCRIPTION OF THE INVENTION

An embodiment of the present invention will be described in detail hereinunder with reference to the accompanying drawings in which the system of the invention is applied to an automatic winder.

Figure 1:
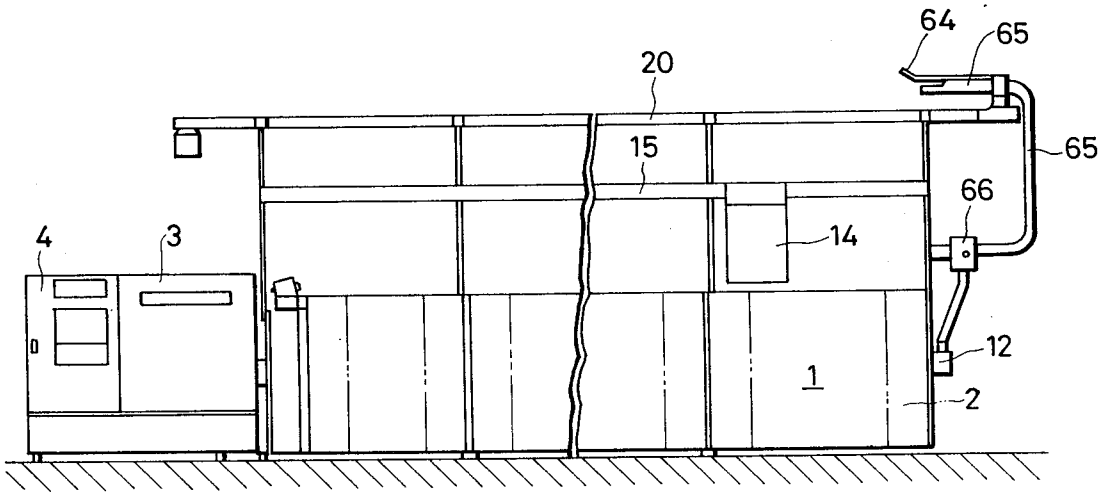
FIG. 1 is a front view showing a frame structure of an automatic winder body.
Figure 2:
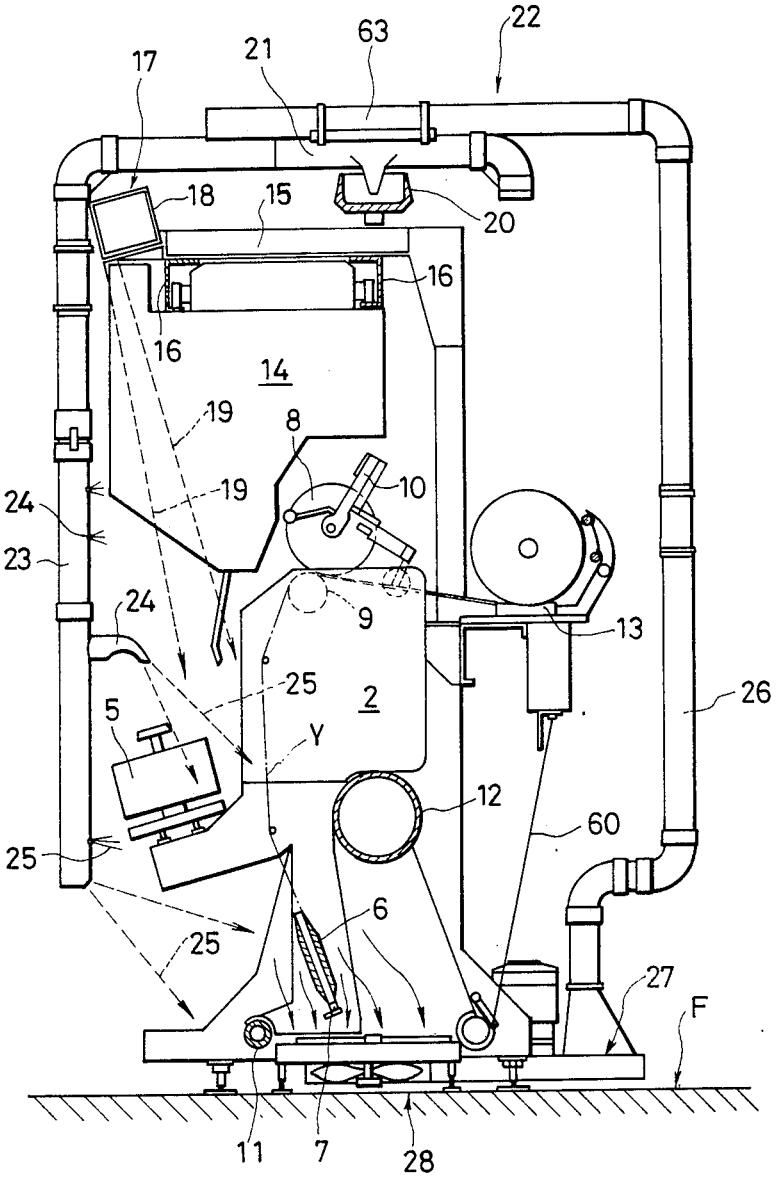
FIG. 2 is a side view of a fly removing system according to an embodiment of the present invention.

Referring first to FIGS. 1 and 2, the reference numeral 1 denotes an automatic winder having many winding units 2 which are disposed side by side, with a blower box 3 and a control box 4 being mounted at an end portion of the winder 1. Each winding unit 2 is provided with a cop stocking magazine 5, a peg 7 for supporting a cop 6 which is chuted from the magazine 5, a traverse drum 9 for taking up the yarn which is drawn out from the cop 6 onto a package 8 while traversing the yarn, a cradle 10 for supporting the package, and further provided with a slub catcher, a waxing device and a knotting device which are not shown. The winding unit 2 is rotatably mounted on a pipe 11 which extends through the winder, and is retained by a suction duct 12. Further, if the yarn travelling side of the winding unit is assumed to be the front, a full package carrying rack or conveyor 13 is provided behind the winding unit along the winder.

The numeral 14 denotes a travelling car which is suspended from a fixed ceiling frame 15 and adapted to move along rails 16. The travelling car 14 is provided with a doffing device for doffing a full package and an empty bobbin feeder for supplying and loading an empty bobbin to the cradle.

In the winder of such a construction, a large quantity of flies are formed from the yarn which is unwound from the cop 6 and is running through a tension device, a guide, etc., and those flies float within the factory. To prevent the flies from being scattered from the winder, an air curtain device 17 is provided. More specifically, a compressed air supply pipe 18 is disposed on the ceiling frame 15 along the winding unit 15, and a compressed air is ejected therefrom downwardly of the front of the winder to create an air current 19 for confining the flies forcibly in the lower portion of the winder.

Further, a rail 20 is laid on the ceiling frame 15 of the winder along the winding unit, and a cleaning device 22 provided with a blower 21 is reciprocated along the rail 20. Flies deposited or adhered to the front of the winding unit are blown off by air 25 which is ejected from nozzles 24 of an air feed pipe 23, while flies deposited on the floor surface are sucked in from a lower end opening 27 of a suction pipe 26 which is adapted to move along the back of the winder.

In the present invention, moreover, a fly collecting device 28 is disposed at every plural winding units at the lower portion of the winder, and the flies accumulated in the collecting device are sucked in and discharged intermittently by the suction pipe 26.

Figure 3:
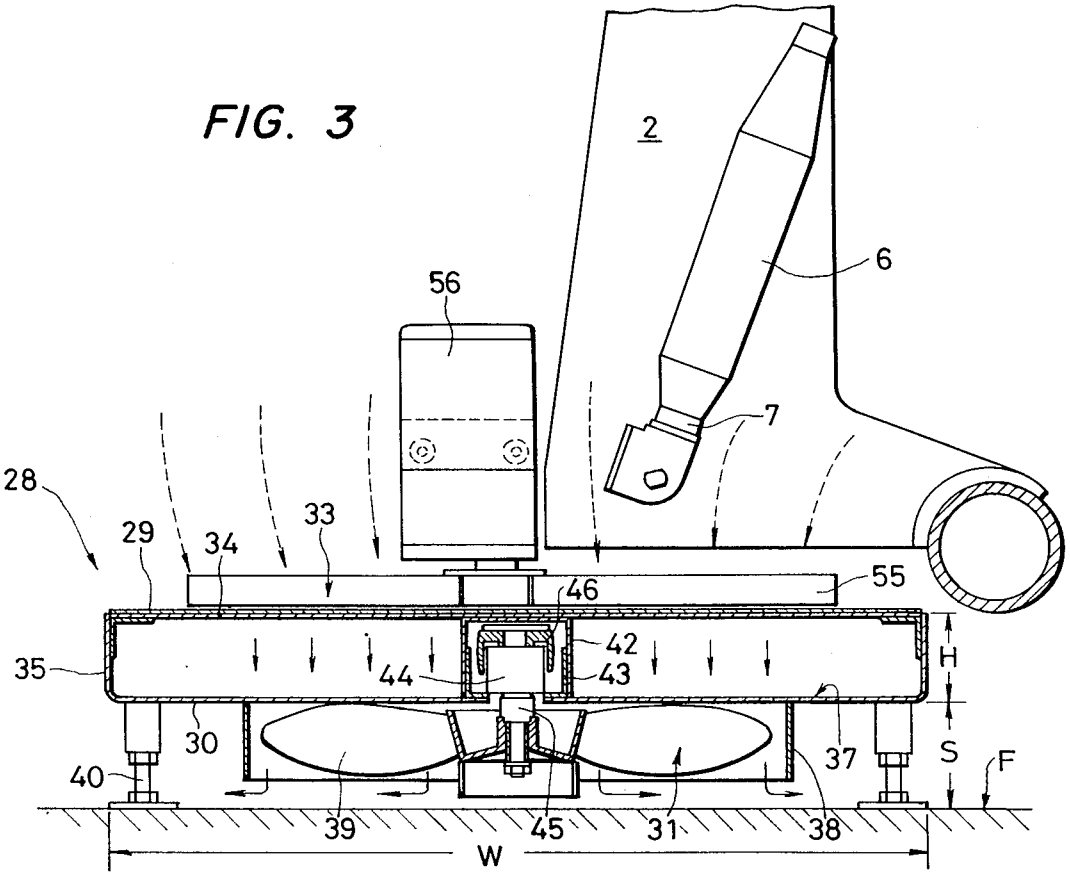
FIG. 3 is a sectional side view showing an example of a fly collecting device.
Figure 4:
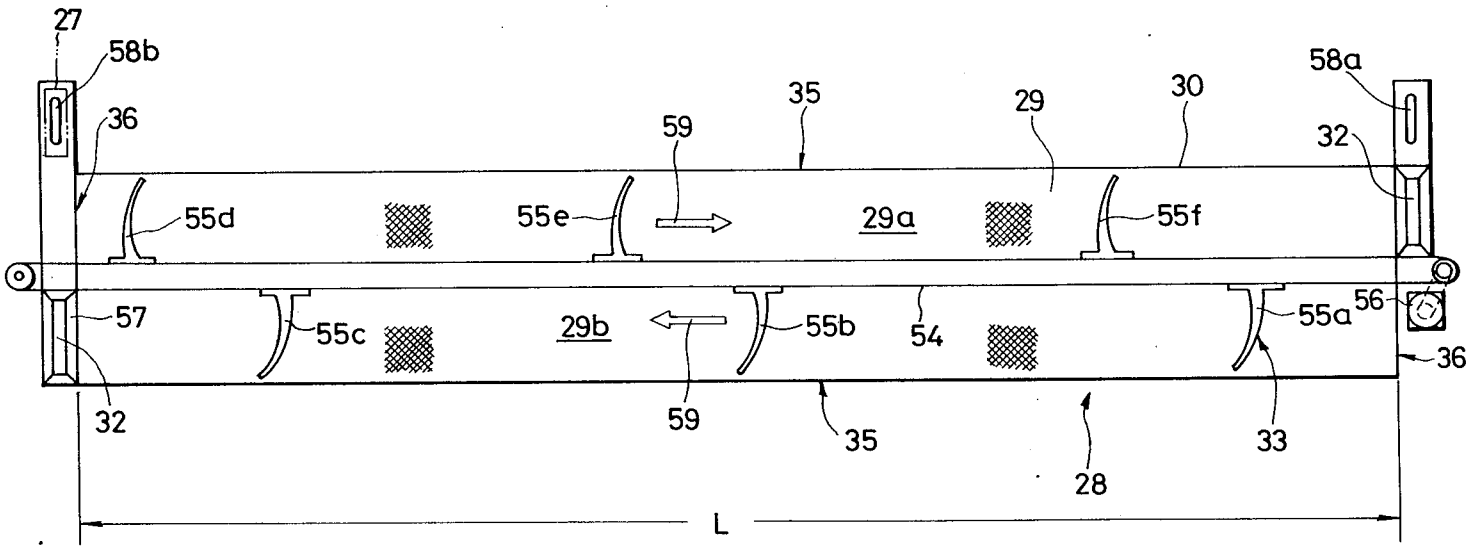
FIG. 4 is a plan view of the device in FIG. 3.

Referring now to FIGS. 3 and 4, the fly collecting device 28, which is provided at every plural winding units as mentioned above, comprises a collector box 30 having an upper surface formed of a wire net 29 of fine mesh, a fan means 31 provided below the collector box 30 and a scrape-up means 33 for scraping up flies deposited on the upper surface of the wire net 29 and storing the scraped-up flies in a storage box 32.

The collector box 30 has a width, W, which is almost equal to the width of the winding unit 2, a length, L, which corresponds to the length of the plural winding units, and a height, H, sufficient to produce a downward suction air current within the collector box. The wire net 29, which is of a fine mesh not passing flies therethrough, is extended without interruption in the form of a substantially horizontal plane free from unevenness to constitute an upper surface of the collector box 30.

Figure 5:
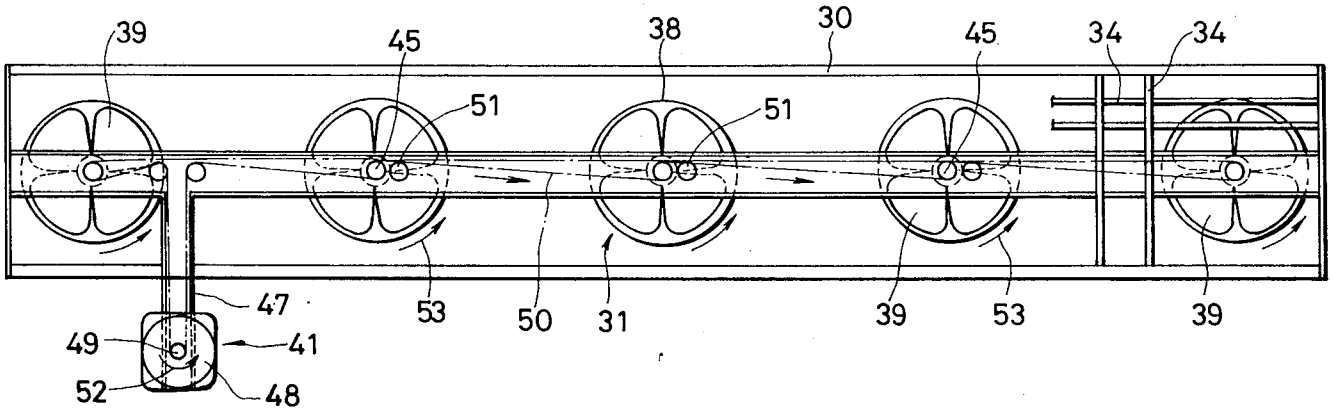
FIG. 5 is a plan view of a fan means of the fly collecting device.
Figure 6:
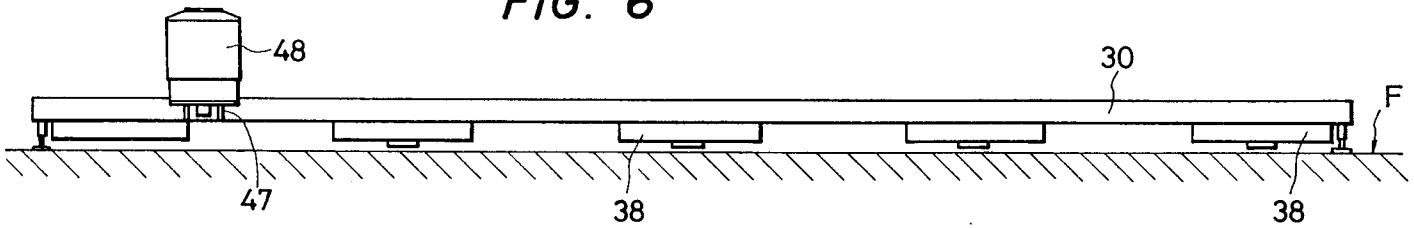
FIG. 6 is a front view of the device in FIG. 5.

The numeral 34 in FIG. 5 denotes a wire net mounting and supporting member extended in the form of a lattice.

Sides 35, end faces 36 and bottom 37 of the collector box 30 are formed of a sheet metal, and a cylinder 38 for fan is formed at plural portions of the bottom 37 downwardly projectedly as shown in FIGS. 3 and 5.

The collector box 30 is fixedly installed with bolts 40 in a position corresponding to a distance, S, from the floor F, namely, in a position which permits a fan 39 to be positioned between the bottom of the collector box and the floor.

The fan means 31 for producing a downward suction air current within the collector box comprises fans 39 which are downwardly supported at appropriate intervals, and a drive unit 41 for driving those fans. As shown in FIG. 3, an upwardly opened-shaped supporting member 43 is fixed to a downwardly opened -shaped fixed steel 42 which extends longitudinally through the collector box, and a bearing 44 is fixed to the support member 43. Further, a vertical shaft 45 is supported rotatably by the bearing 44, and the fan 39 is fixed with bolt or the like to the lower end of the vertical shaft 45, while to the upper end of the shaft 45 is fixed a touch roller 46. The drive unit 41 for the fans 39, as shown in FIG. 5, comprises a motor 48 which is provided downwardly on a frame 47 in a position outside the collector box, a single endless belt 50 engaged with a rotating shaft 49 of the motor 48, and guide pulleys 51 for bringing the belt 50 into pressure contact with the touch rollers 46 of the fans. As the motor 48 rotates in the direction of arrow 52, the fans 39 are rotated in the same direction 53.

The scrape-up means 33 for scraping up the flies deposited on the upper surface of the collector box 30 will now be described with reference to FIGS. 3 and 4. On the upper surface of the collector box 30 and at the central portion in the width direction of the box 30, an endless belt 54 or chain is moved along the longitudinal direction of the collector box. To the sides of the belt 54 are fixed scrapers 55 at predetermined intervals, the scrapers 55 being formed of a flexible material. The belt 54 is moved and allowed to slide on the wire net at predetermined time intervals by means of a motor or any other suitable drive source to scrape up the flies on the wire net through the scrapers. At both ends of the collector box 30 are provided storage boxes 32 for storing the scraped-up flies.

Figure 7:
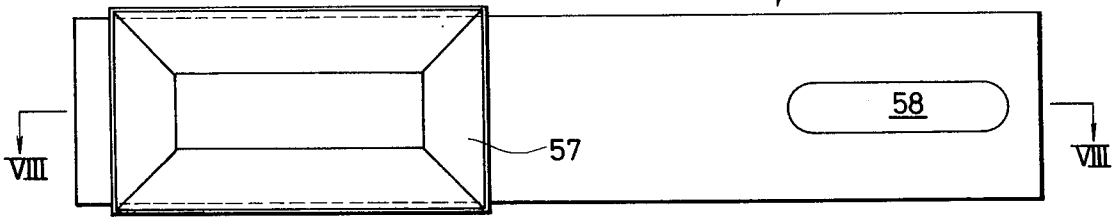
FIG. 7 is a plan view showing an example of a fly lump storage box 32.
Figure 8:
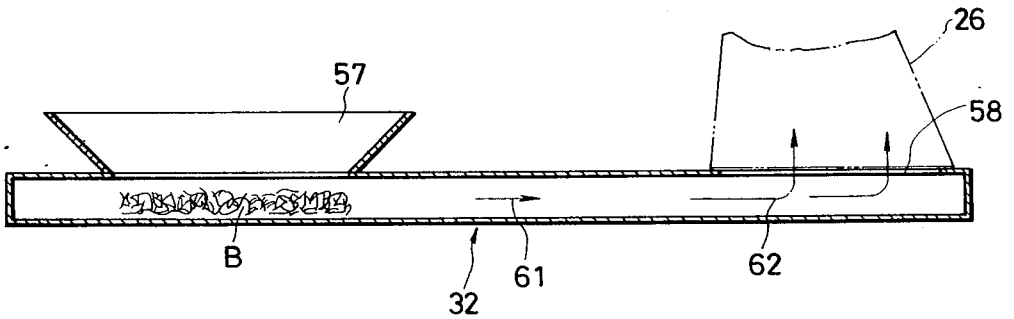
FIG. 8 is a sectional side view of the box in FIG. 7.
Figure 9:
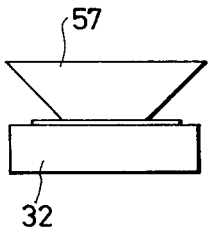
FIG. 9 is a front view of the box in FIG. 7.

The storage box 32, as shown in FIGS. 7 through 9, is provided at one end portion thereof with an inclined guide 57 for guiding the flies downwardly into the box 32, and at the other end portion thereof with an elongated opening 58 connected to the lower-end opening of the suction pipe 58 which moves along the winder.

In FIG. 4, the right-hand storage box 32 is for storing the flies deposited on a wire net portion 29*a* on one side of the belt 54 at the upper surface of the collector box 30, while the left-hand storage box 32 is for storing the flies deposited on a wire net portion 29*b* on the other side of the belt 54. Therefore, since openings 58*a* and 58*b* are located on the moving path of the suction pipe, the boxes 32 have different lengths.

Consequently, when the belt 54 is moved in the direction of arrow 59 in FIG. 4 by the motor 56 at every predetermined time set with a timer, for example, at every hour, the flies accumulated on the wire net portion 29*b* are scraped up by scrapers 55*a*, 55*b* and 55*c* and are moved to the left on the wire net until the flies drop into the left-hand storage box 32 and are stored therein. At the same time, the flies accumulated on the opposite-side wire net portion 29*a* are scraped up and moved to the right by scrapers 55*d*, 55*e* and 55*f* until the flies drop into the right-hand storage box 32 and are stored therein.

Thus, there are provided plural scrapers 55*a*–55*f* and this is for the following reason. For example, the flies on the wire net portion between the scrapers 55*b* and 55*c* are supposed to be scraped up by the scraper 55*b*, but part of the flies not scraped up by the scraper 55*b* are scraped up by the succeeding scraper 55*a*, so that most of the flies on the wire net portion 29*b* are scraped up. Thus, the provision of plural scrapers is effective in removing flies. Further, the scrapers 55*a*–55*f* are each formed in the shape of a curved surface, and this is for preventing the flies being scraped up ad moved from escaping outwardly from the scrapers, namely, toward the side portions of the wire net.

The fly removing system having the above-described construction operates in the following manner.

In FIGS. 2 and 3, while the automatic winder 1 is in operation, a large quantity of flies are formed from the cop 6 and also from yarn Y being drawn out from the cop and the flies float in the air due to ballooning of the yarn or a high-speed rotation of the package 8, but since the air curtain 19 is formed by the air ejected from the compressed air supply pipe 18, the flies are prevented from being scattered into the factory and are conducted to the lower portion of the winder. Below the winder is disposed the collector box 30 and the fans 39 are rotating to generate an air current within the collector box 30 which current flows from the upper surface to the bottom of the collector box to conduct the floating flies onto the wire net 29 of the collector box and let them adhere thereto. Also by the air ejected toward the front of the winding unit from the air feed pipe 23 which is moving along the winder 1, the flies deposit on the winding unit are blown off onto the upper surface of the collector box 30.

The numeral 60 in FIG. 2 denotes a curtain for preventing the scattering of flies. The curtain 60, which is formed of a transparent nylon or like material at the lower portion of the back of the winder, is capable of being opened and closed along the winder.

Consequently, during operation of the winder, a large quantity of flies are deposited like a snow heap on the upper surface of the collector box 30. According to an actual measurement, a fly layer of about 4 mm thick is formed per hour.

When the fly scrape-up means 33 is operated at every present time, that is, when the motor 56 shown in FIG. 4 is driven at every hour by using a timer, for example, the scrapers 55*a*–55*f* on the wire net move in the direction of arrow 59, whereby the flies deposited on the wire net 29 are scraped up and dropped as fly lumps into the fly storage boxes 32 which are connected to both end portions of the collector box. During this period, the fans 39 in the collector box keep on rotating to prevent scattering and escape of the flies from the upper surface of the wire net.

Then, when the lower-end opening 27 of the suction pipe 26 which moves along the winder reaches the position aligned with the opening 58 of each storage box 32, the fly lump B stored therein is instantaneously moved in the direction indicated with arrows 61 and 62 and sucked through the opening 58 into the suction pipe 26 by virtue of the suction force of the suction pipe 26.

In this way, while the suction pipe 26 moves along the winder, it sucks in the fly lumps in the storage boxes successively and once stores the flies in a fly reservoir 63 provided at the upper portion of the cleaning device. Then, when the cleaning device 22 reaches an end portion or a right-hand end portion in FIG. 1, a door (not shown) of the cleaning device is opened by a cam piece 64 fixed to the frame 20, and a suction pipe 65 disposed in the vicinity of the cam piece 64 and the fly reservoir 63 are brought into connection with each other, whereby the fly lumps in the fly reservoir 63 are fed through the suction pipe into a dust box 66 which is provided in a position adjacent to the winder. The suction pipe 65 is connected to the main pipe 12 extending through the main pipe 12 to produce a suction air current therein, and the dust box 66 is attached to the portion of the pipe 65 substantially corresponding to the height of the operator, thereby permitting the operator to take out any time the fly lumps, yarn waste, etc. accumulated in the dust box 66.

What is claimed is:

1. A fly removing system in a textile machine wherein an air curtain is formed by air ejected from a compressed air supply source and flies are conducted to a lower portion of textile machine, comprising:

a plurality of winding units;

a fly collector means mounted at the lower portion of each of the winding units, said fly collecting means comprising a fly collector box and a scrape-up means for scraping up flies deposited on an upper surface of the collector box and storing the scraped-up flies as fly lumps;

a cleaner means having a suction pipe for sucking and storing said fly lumps, said cleaner means disposed adjacent to and adapted to travel along said plurality of winding units while sucking in the fly lumps and discharging the stored fly lumps into a fixed dust box in a predetermined position of its traveling path;

wherein said fly collector means further includes a fan means disposed below the collector box; and wherein said collector box has a depth sufficient to produce a downward suction air current therein and a wire net which is of a fine mesh not passing flies therethrough extends along the untis to constitute the upper surface of the collector box.

2. A fly removing system as claimed in claim 1, wherein said fan means includes fans which are downwardly supported and a driving means for the fans comprising a motor, a single endless belt engaged with a rotating shaft of the motor and guide pulleys for bringing the belt into pressure contact with touch rollers of the fans.

3. A fly removing system as claimed in claim 2, wherein said scrape-up means comprises an endless belt or chain which is moved along the longitudinal direction of the collector box on the upper surface of the collector box and at the central portion in the width direction of the box, said scrape-up means being formed of a flexible material and fixed to a side of the belt at predetermined intervals, and a drive source for the belt.

4. A fly removing system as claimed in claim 3 wherein said fly storage area comprises storage boxes provided at both ends of the collector box for storing the scraped-up flies.

5. A fly removing system as claimed in claim 4, wherein said storage box is provided at one end portion thereof with an inclined guide for guiding the flies downwardly therein and at the other end portion thereof with an elongated opening connected to a lower-end opening of the suction pipe which moves along the textile machine.

6. A fly removing system as claimed in claim 3, wherein said scraper member is formed in the shape of a curved surface toward the advancing direction thereof.

* * * * *